US007140065B2

(12) United States Patent
Boos et al.

(10) Patent No.: US 7,140,065 B2
(45) **Date of Patent: *Nov. 28, 2006**

(54) PIPELINE SURFACE FOR INSPECTION WITH DEBRIS COLLECTION

(75) Inventors: Frederick A. Boos, Temple Terrace, FL (US); Edward N. Fite, Riverview, FL (US); Marcus Alexich, Plant City, FL (US)

(73) Assignee: AMEC Pipeline Professionals, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/994,522

(22) Filed: Nov. 22, 2004

(65) Prior Publication Data

US 2005/0210619 A1 Sep. 29, 2005

Related U.S. Application Data

(63) Continuation of application No. 10/063,272, filed on Apr. 5, 2002, now Pat. No. 6,832,406.

(51) Int. Cl.
*B05B 15/10* (2006.01)

(52) U.S. Cl. ..... 15/302; 15/308; 15/309.1

(58) Field of Classification Search ..... 15/300.1, 15/312.1, 309.1, 302, 319, 308
See application file for complete search history.

(56) References Cited

U.S. PATENT DOCUMENTS

| | | | |
|---|---|---|---|
| 3,530,526 | A | 9/1970 | Schmidt |
| 4,540,445 | A | 9/1985 | Burns, Jr. |
| 4,591,390 | A | 5/1986 | Scott et al. |
| 4,677,998 | A | 7/1987 | van Voskuilen et al. |
| 4,953,496 | A | 9/1990 | Taylor et al. |
| 5,052,423 | A | 10/1991 | Chapman et al. |
| 5,056,271 | A | 10/1991 | Rose |
| 5,069,234 | A | 12/1991 | Nielsen |
| 5,074,323 | A | 12/1991 | Chapman et al. |
| 5,085,016 | A | 2/1992 | Rose |
| 5,092,357 | A | 3/1992 | Chapman et al. |
| 5,107,633 | A | 4/1992 | Rose |
| 5,129,355 | A | 7/1992 | Taylor et al. |
| 5,136,969 | A | 8/1992 | Chapman |
| 5,178,171 | A | 1/1993 | Chapman et al. |
| 5,191,740 | A | 3/1993 | Rose |
| 5,199,226 | A | 4/1993 | Rose |
| 5,209,245 | A | 5/1993 | Chapman et al. |
| 5,216,849 | A | 6/1993 | Clack et al. |
| 5,226,973 | A | 7/1993 | Chapman et al. |
| 5,238,331 | A | 8/1993 | Chapman |
| 5,265,634 | A | 11/1993 | Chapman et al. |

(Continued)

*Primary Examiner*—Theresa T. Snider
(74) *Attorney, Agent, or Firm*—Patterson & Sheridan, L.L.P.

(57) ABSTRACT

A machine for surface preparation of a pipeline includes a vacuum shroud that encircles the pipeline. Three manifolds, each housing a plurality of ultra high pressure water nozzles, are mounted in the vacuum shroud at circumferentially spaced intervals. A carrier assembly advances the vacuum shroud along the pipeline at a rate that avoids contact between the water jets and uncoated pipe. The shroud also oscillates about a longitudinal axis of the pipeline so that a short extent of the pipeline is subjected to the force of the water for each oscillation. The vacuum in the shroud carries away all debris created by the coat-stripping process to a closed loop filtration and recycling system. The nozzles are mounted a constant stand-off distance from the pipeline to avoid creation of hot spots during the stripping process. All motions are electronically monitored and detection of any movement failure results in system shutdown.

20 Claims, 7 Drawing Sheets

U.S. PATENT DOCUMENTS 5,267,417 A 12/1993 Rose
5,359,748 A 11/1994 Etheridge
5,361,791 A 11/1994 Chapman et al.
5,385,609 A 1/1995 Rose et al.
5,398,461 A 3/1995 Rose
5,433,381 A 7/1995 Stenzel et al.
5,458,683 A 10/1995 Taylor et al.
5,520,734 A 5/1996 Taylor et al.
5,615,696 A 4/1997 Lawler
5,626,438 A 5/1997 Etheridge
5,647,906 A 7/1997 Monday et al.
5,743,969 A 4/1998 Lawler
6,461,231 B1 10/2002 Taylor et al.

PIPELINE SURFACE FOR INSPECTION WITH DEBRIS COLLECTION

CROSS-REFERENCE TO RELATED APPLICATIONS

This application is a continuation of U.S. patent application Ser. No. 10/063,272, filed Apr. 5, 2002, which issued as U.S. Pat. No. 6,832,406 on Dec. 21, 2004, which patent application is incorporated by reference herein.

BACKGROUND OF THE INVENTION

1. Field of the Invention

This invention relates, generally, to pipeline surface preparation systems. More particularly, it relates to machines that travel along the length of a pipeline and remove coating therefrom by the application of water jets at ultra high pressure.

2. Description of the Related Art

The disclosure made in U.S. Pat. No. 5,238,331 to Chapman is believed to be relevant to the present invention because it describes a pipeline surface preparation system that is sufficiently light-in-weight to enable a team of two workers to place it into position around a pipeline in the absence of weight-lifting machinery. A frame surrounds the pipeline and the frame supports wheels that engage the surface of the pipeline and enable the pipeline surface preparation system to travel along the extent thereof. Moreover, the Chapman apparatus employs water jets to strip coating from a pipeline. Water nozzles are circumferentially spaced about the perimeter of the pipeline and limit switches are employed to cause the frame that carries the nozzles to reciprocate along a circumferential path of travel so that hoses connected to the apparatus are not wrapped around the pipeline as the apparatus advances along the length thereof.

The invention disclosed in the Chapman patent therefore solves several problems left unsolved by earlier advances in the field. Earlier devices are so heavy that a crane is needed to lower them into position atop a pipe. The weight of such devices causes the pipe to sag and thus limits the length of pipeline that can be excavated at any one time. When a crane drops one of the early heavy pipeline surface preparation systems onto a pipeline, catastrophic explosions may occur.

However, the art has not heretofore solved all of the outstanding problems associated with pipeline surface preparation systems. One of the outstanding, unsolved problems relates to handling of debris generated by the pipe coating removal process. Old coating commonly includes asbestos and other materials that require special handling. However, the pipeline surface preparation systems of the prior art do not adequately address the debris-handling problem. The conventional wisdom is that Visqueen® plastic or other suitable sheet material should be placed in overlying relation to the ground below the pipeline undergoing reconditioning. Asbestos and other debris is thus collected atop the plastic sheet material as the machine travels along the extent of the pipeline. Workers then carefully fold the plastic sheet material in an attempt to contain the hazardous materials deposited thereatop. The inadequacies of this well-known procedure are readily apparent. Asbestos in small pieces may easily float in the air beyond the reaches of the plastic sheet material and enter the lungs of workers in the vicinity. Asbestos may also enter the lungs of those who attempt to collect it by folding the plastic sheet material into a collection means.

A pipeline surface preparation system that prevents asbestos and other hazardous debris from escaping into the atmosphere and that minimizes total contaminated waste is clearly needed.

The earlier pipeline surface preparation systems also slip from time to time as they travel along a pipe because insufficient engagement is provided between the pipe surface and the rollers or wheels that rotatably engage said surface to cause the pipeline surface preparation system to travel along the pipe. When a pipeline surface preparation system slips, the pipeline can be damaged because the water jets have extended dwell time on the surface. It is very important that the extremely high pressure water jets that are used to strip away pipe coating be applied to the surface with controlled speed and rotation. When a pipeline surface preparation system carrier means slips, exposed pipe is subjected to the full power of the high pressure water jets for an extended time and pipeline damage may occur. A pipeline surface preparation system having improved traction is therefore needed.

A closely related problem is known in the industry as the "hot spots" problem. A "hot spot" is a location on a pipe surface that is subjected to more water pressure than other sections. A hot spot is created whenever a nozzle passes closer to the surface of the pipe in one location than it does in another. Thus, a hot spot may be created by slippage of the transported means as just mentioned, or it may be created by the inherent structural features of the pipeline surface preparation system. The prior art includes a nozzle assembly where a pair of nozzles is mounted to opposite ends of a rotating conduit that is straight in configuration. As a result, the nozzles pass closer to the surface of the pipe in some locations than others, giving rise to the problem of hot spots.

A need therefore exists for a structural design that eliminates hot spots by ensuring that all nozzles are spaced equally from the pipe surface at all times.

It is also important to monitor the air supply and the operation of all water-emitting nozzles because any failed movement will direct a high pressure water stream to a single spot and thereby damage the pipe. Automatic monitoring means should therefore be connected to the air supply, each nozzle, and other movable parts. A means should be provided for sending a "shut-down" signal to the ultra high pressure system when any required motion fails.

Yet another outstanding problem relates to the debris created by the stripping action of the water jets. The known pipeline surface preparation systems produce debris in large particle size. The art has addressed this problem by providing an external shredding means to reduce the debris particles to a more manageable size. The price of an external shredder increases the cost of the system, the time required to operate the external shredder decreases productivity, and the operation of the shredder could potentially add to environmental concerns with hazardous wastes.

However, in view of the prior art considered as a whole at the time the present invention was made, it was not obvious to those of ordinary skill in the art how the known pipeline surface preparation systems could be improved.

SUMMARY OF THE INVENTION

The long-standing but heretofore unfulfilled need for a machine that performs surface preparation of pipelines by stripping coating therefrom is now met by a new, useful, and nonobvious invention.

The novel structure includes a vacuum shroud having a main wall that surrounds a longitudinally-extending section of a pipeline. The vacuum shroud has end walls that are apertured to receive the pipeline. A plurality of equidistantly and circumferentially spaced apart nozzle openings are formed in the main wall and an ultra high pressure water nozzle is positioned within each of the nozzle openings.

A carrier assembly causes the vacuum shroud to travel along the extent of the pipeline in a predetermined direction. An oscillating means oscillates the vacuum shroud in a first rotational direction and in a second rotational direction opposite to the first rotational direction as the vacuum shroud travels along the pipeline.

A vacuum opening is formed in the vacuum shroud at a lowermost end thereof. A vacuum hose has a leading end connected to the vacuum opening and a trailing end adapted to be connected to a remote source of negative pressure. A filter trap disposed between the vacuum opening and the remote source of negative pressure collects debris stripped from the pipeline. Accordingly, debris collected within the filter trap is not discharged into the atmosphere.

The carrier assembly includes a frame having a leading end that circumscribes the pipeline, a trailing end that circumscribes the pipeline, and interconnecting frame members that interconnect the leading end and the trailing end to one another. Stand-off means in the form of a plurality of wheel members that are rotatably mounted to the frame rollingly engage the pipeline and position the frame in concentric, encircling relation thereto.

The carrier assembly further includes a driving wheel assembly that includes a leading drive wheel and a trailing drive wheel that are in line with one another and which rollingly engage the pipeline at longitudinally spaced apart points. The driving wheel assembly surmounts the pipeline.

The main wall of the vacuum shroud has a cylindrical main body and a wedge-shaped lower body formed integrally therewith. The lower body has a lowermost point positioned coincident with a vertical plane that bisects the pipeline when the machine is in a position of equilibrium so that debris created when said coating is stripped from the pipeline falls under the influence of gravity into the wedge-shaped lower body.

Each of the nozzle openings is formed in the cylindrical main body so that each high pressure water nozzle is spaced a common distance from the pipeline so that hot spots are not created when the machine is in operation.

An automatic motion sensing system sends a signal to a shut-down control system to immediately deactivate the machine when a motion failure is electronically detected.

A closed loop filtration system filters and recycles liquid used in a cleaning process of the machine.

An important object of the invention is to provide a pipeline surface preparation system that substantially prevents hazardous materials from entering the atmosphere and minimizes waste to be disposed of during a pipe reconditioning process.

Another important object is to provide a carrier means that provides an increased amount of traction between the surface of the pipeline and the wheels or rollers that engage said surface.

Still another important object is to provide non-destructive cleaning of a pipeline that eliminates the "hot spot" problem that has troubled the industry for many years.

Another object is to provide a control means that automatically deactivates the system when any required motion fails so that damage caused by such motion failure may be prevented.

Yet another object is to provide a pipeline surface preparation system that shreds debris into very small particles so that no external shredder means is required.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
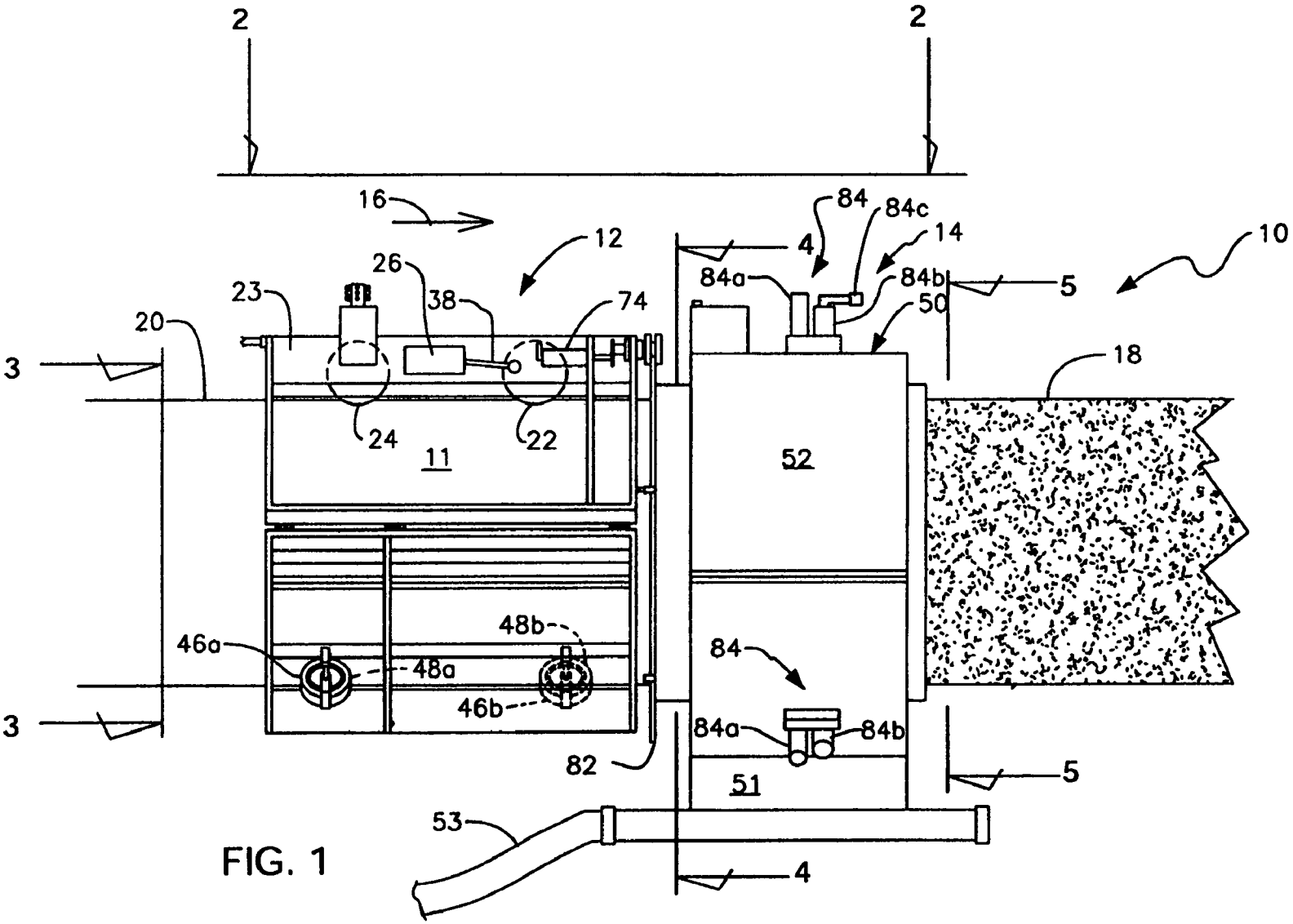
FIG. 1 is a side elevational view of the novel pipeline surface preparation system.

Referring now to FIG. 1, it will there be seen that a preferred embodiment of the invention is denoted as a whole by the reference numeral 10.

Pipeline surface preparation system 10 has two primary parts. The first part is denoted 12 as a whole and performs the function of advancing machine 10 along the extent of pipeline 11. The second part is denoted 14 as a whole and performs the function of removing coating from said pipeline.

In FIG. 1, the direction of travel of machine 10 is denoted by directional arrow 16. Pipe coating to be removed is denoted 18 and pipe from which the coating has been removed is denoted 20.

First part 12, hereinafter referred to as carrier assembly 12, has an open frame construction as depicted so that it is light-in-weight. Carrier assembly 12 contains all major mechanical, electrical, hydraulic, and pneumatic components and controllers. If any part of the assembly fails, the entire drive system can be quickly replaced and subsequently repaired off-line. It is standard to a number of pipe sizes so a spare is always available.

Figure 2:
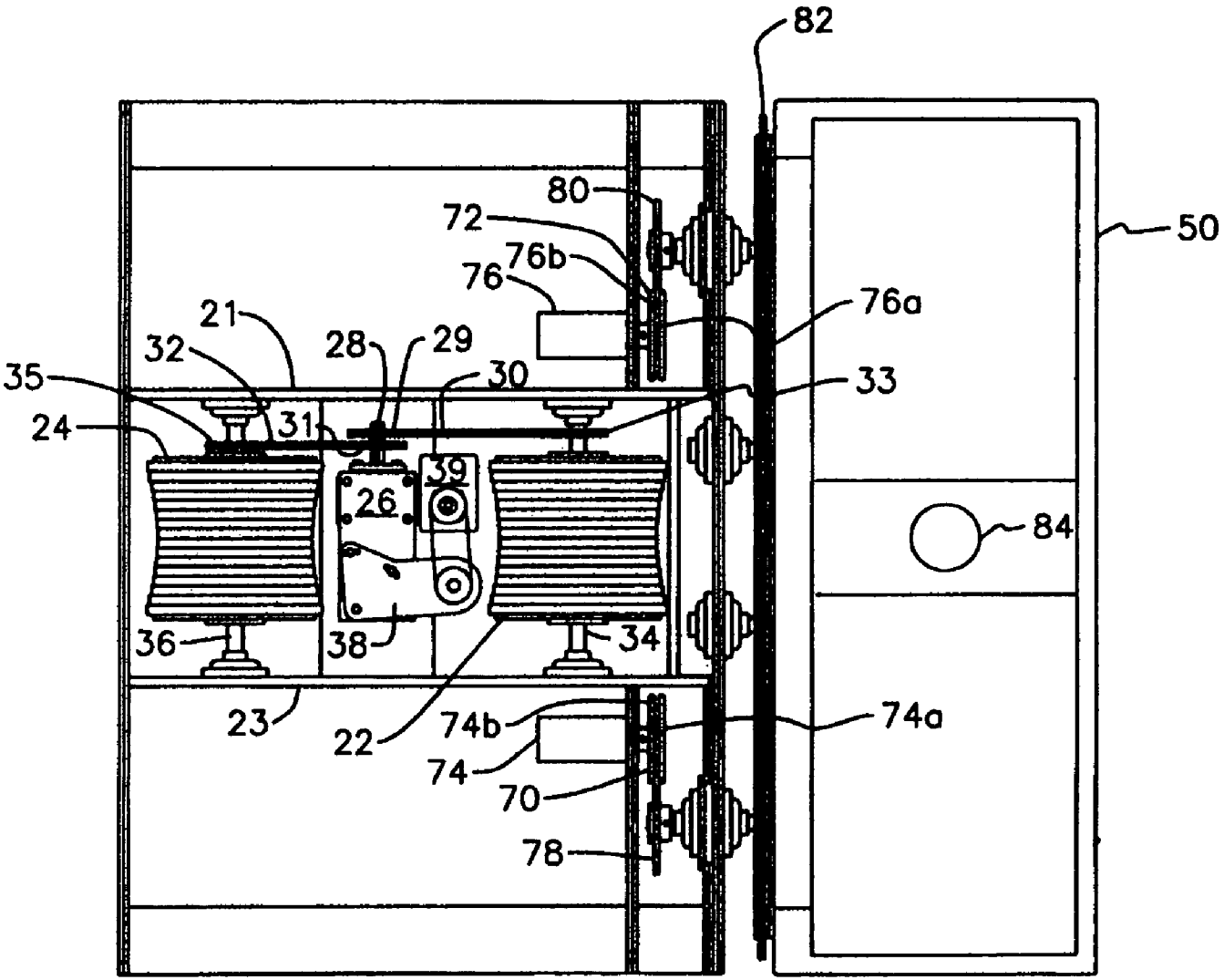
FIG. 2 is a top plan view taken along line 2—2 in FIG. 1.
Figure 8:
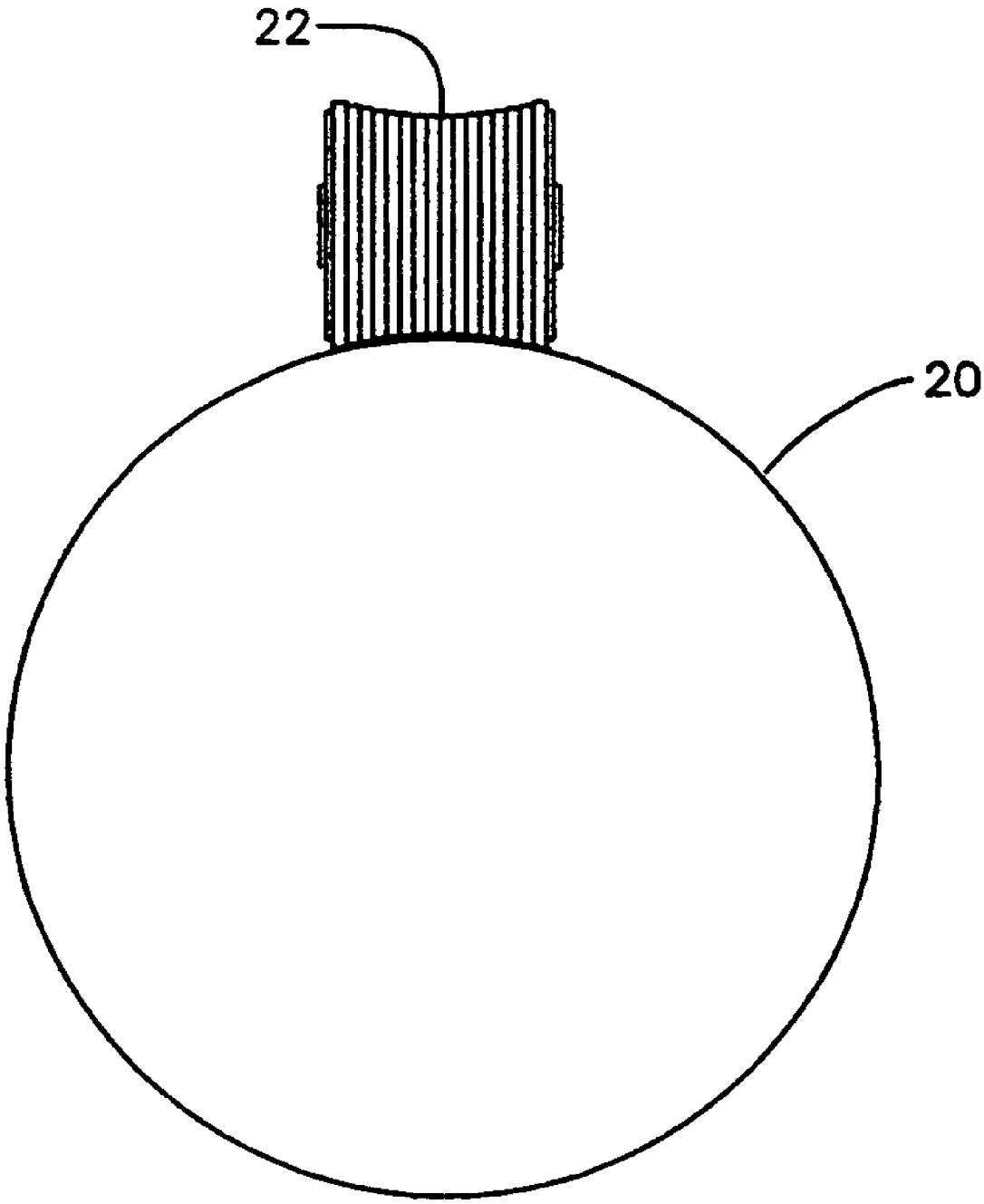
FIG. 8 is a simplified end view depicting how the drive wheels are contoured to fit the contour of a pipeline undergoing surface preparation.

As best understood in connection with FIG. 2, leading drive wheel 22 and trailing drive wheel 24 are rotatably mounted on axles having their opposite ends supported by mounting plates 21, 23, respectively, that form a part of the frame assembly. Drive wheels 22, 24 are in longitudinal alignment with one another and are typically of rubber construction. Each of the drive wheels is contoured as depicted in FIGS. 2 and 8. The concave curvature of each wheel matches the convex curvature of the pipeline to enhance the traction between the wheels and the pipeline. Moreover, the surface of each wheel has a sawtooth or geartooth tread to further enhance the traction. Wheels 22, 24 drive pipeline surface preparation system 10 at a controlled constant rate of forward speed along the pipeline. Machine 10 is driven by wheels 22, 24 up inclines as steep as fifty degrees or down declines of the same degree. Carrier assembly 12 will also follow long radius pipeline curves.

Wheels 22, 24 prevent slippage of carrier assembly 12 relative to pipeline 11. This ensures that pipe stripped of its coating will not be subjected to extended dwell time.

As perhaps best understood in connection with FIG. 2, wheels 22 and 24 are driven by hydraulic motor 26. More particularly, output shaft 28 is connected in driving relation to gears 29, 31 that drive belts 30, 32, respectively. Belts 30, 32 drive gears 33, 35 that are mounted on axles 34, 36 upon which drive wheels 22, 24 are mounted, respectively.

Control lever 38 is connected as depicted to gearbox 39 and enables an operator to place motor 26 into forward, stop or reverse.

Figure 3:
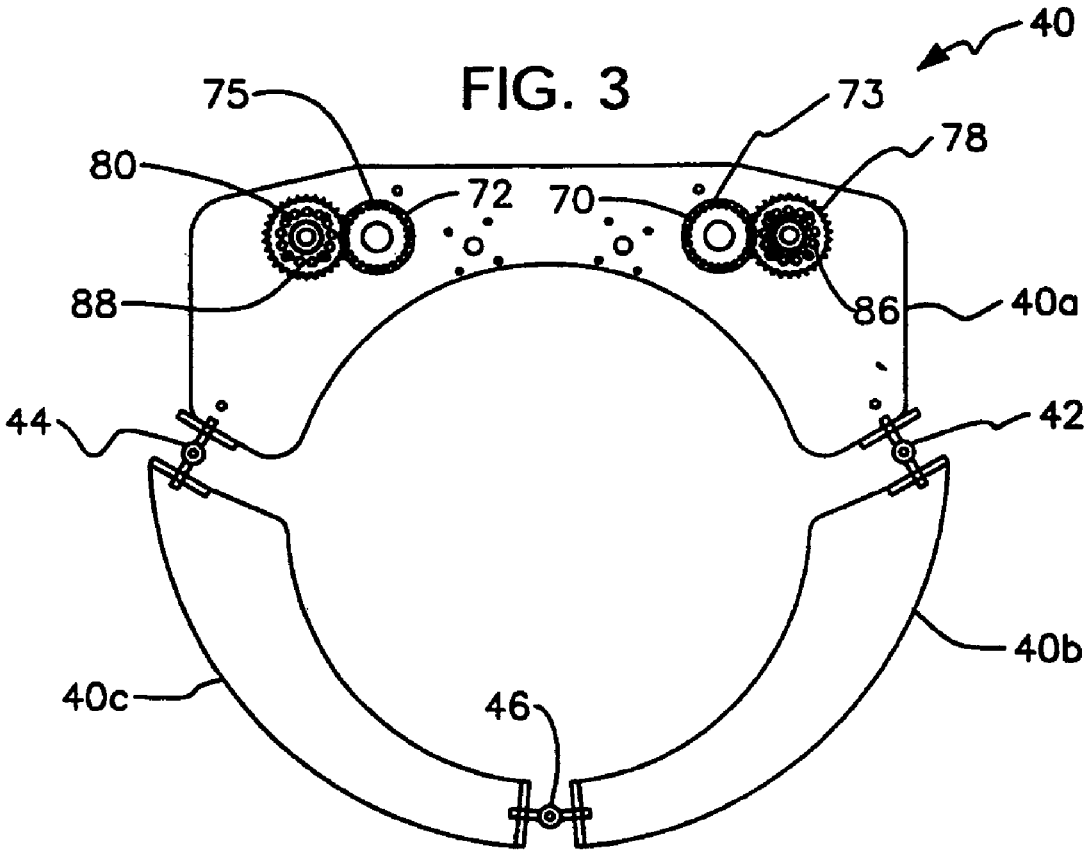
FIG. 3 is an end view taken along line 3—3 in FIG. 1.

As best understood in connection with FIG. 3, frame 40 includes a top part 40*a*, first bottom part 40*b*, and second bottom part 40*c*. Each of said parts has a frame-like construction so that it is light-in-weight. Top part 40*a* is positioned above the pipe in spaced relation thereto. First side part 40*b* is releasably connected to a first end of top part 40*a* by quick-release coupling means 42 and second side part 40*c* is releasably connected to a second end of top part 40*a* by quick-release coupling means 44. First and second side parts 40*b*, 40*c* are releasably connected to one another by quick-release coupling means 46. Two workers lift top part 40*a* into position. Workers standing on opposite sides of the pipeline then engage first and second parts 40*b* and 40*c* thereto and to one another.

Wheels 46*a* and 46*b* (FIG. 1) are circumferentially spaced one hundred twenty degrees from drive wheels 22, 24 and are on opposite sides of carrier 12. Wheels 48*a* and 48*b* of the same construction are also circumferentially spaced one hundred twenty degrees from drive wheels 22, 24 and the same number of degrees from wheel 46*a*, 46*b* and are also on opposite sides of carrier 12. Wheels 46*a*, 46*b* and 48*a*, 48*b* are mechanically compressed against cleaned surface 20 and cooperate with drive wheels 22, 24 to maintain the frame of driving apparatus 12 in concentric alignment with the pipeline. Wheels 46*a*, 46*b*, 48*a*, and 48*b* are passive, however, and do not provide any motive force to the travel of driving apparatus 12 along the extent of the pipeline.

Figure 4:
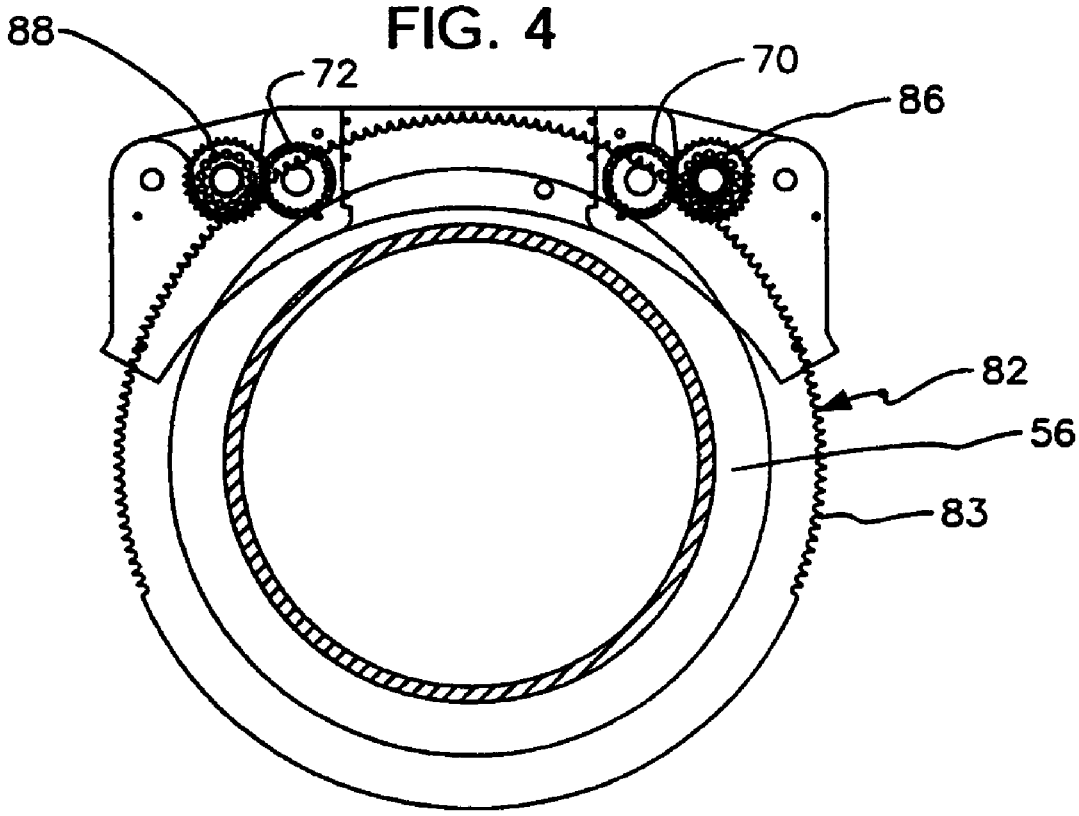
FIG. 4 is a sectional view taken along line 4—4 in FIG. 1.

Second part 14 includes vacuum shroud 50 that circumscribes pipeline 11 in leading relation to driving apparatus 12. Vacuum shroud 50 includes a first cylindrical wall 52 that circumscribes pipeline 11 and a pair of centrally apertured end walls. End wall 54 is depicted in FIG. 5 and end wall 56 is depicted in FIG. 4.

Figure 5:
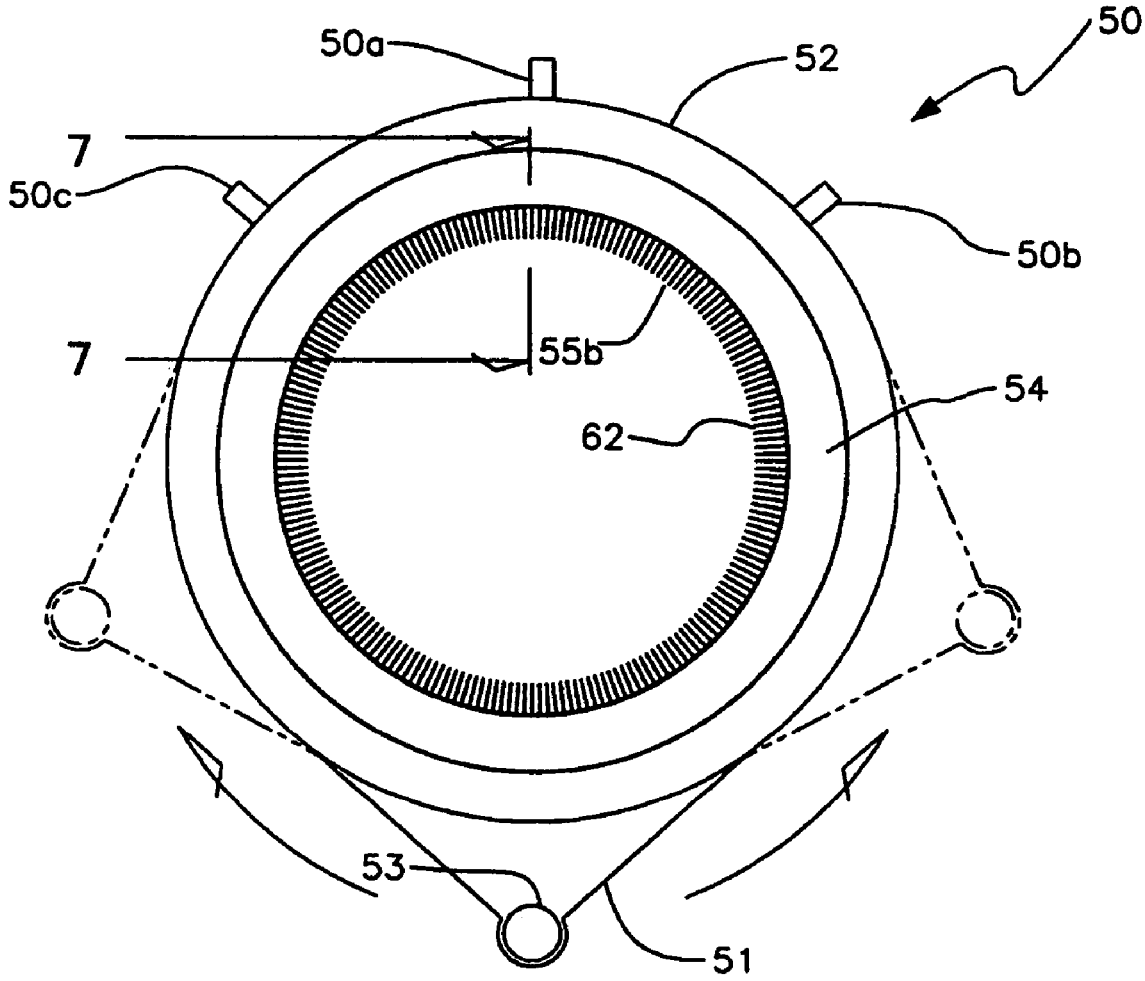
FIG. 5 is a sectional view taken along line 5—5 in FIG. 1.
Figure 6:
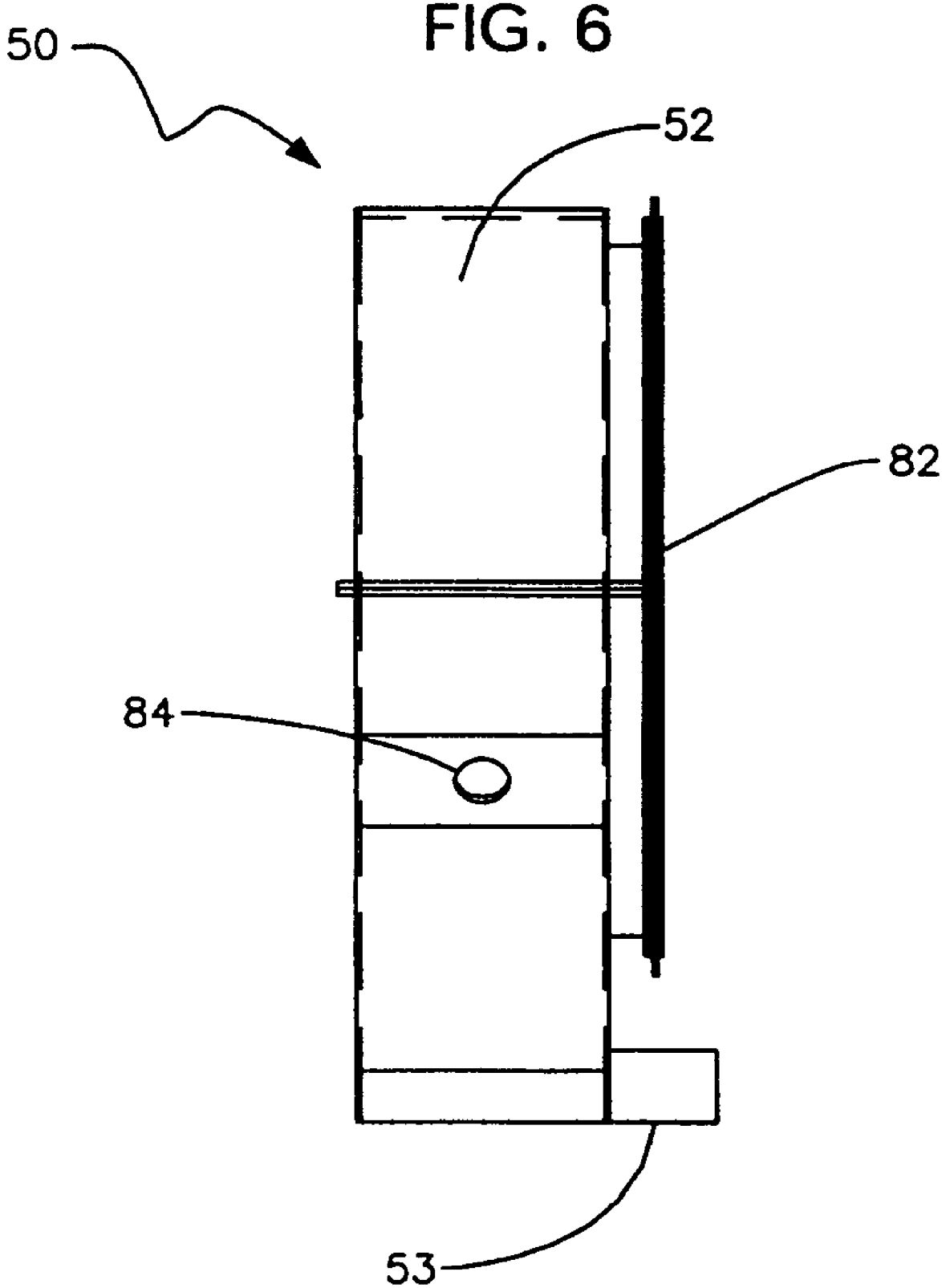
FIG. 6 is a side elevational view of novel vacuum shroud means.

As best understood in connection with FIGS. 1 and 5, a wedge-shaped debris collection chamber 51 is integrally formed with vacuum shroud 50 at its lowermost end. Vacuum hose 53 has a trailing end, not shown, in fluid communication with a remote source of negative pressure. The leading end of said vacuum hose 53 is in fluid communication with wedge-shaped debris collection chamber 51 as depicted. It should be understood that the hollow interior of vacuum shroud 50 and the hollow interior of wedge-shaped debris collection chamber 51 are in open communication with one another. Debris created by removal of the pipe coating thus falls under the influence of gravity into debris collection chamber 51. The rocking motion of vacuum shroud 50 further serves to facilitate collection of debris within said debris collection chamber.

As will be better understood as this description proceeds, the ultra high pressure and unique nozzle movement of the novel machine shreds the debris created by removal of the pipe coating into particles that are typically no larger than a quarter inch in diameter. No external shredder is therefore required.

Figure 7:
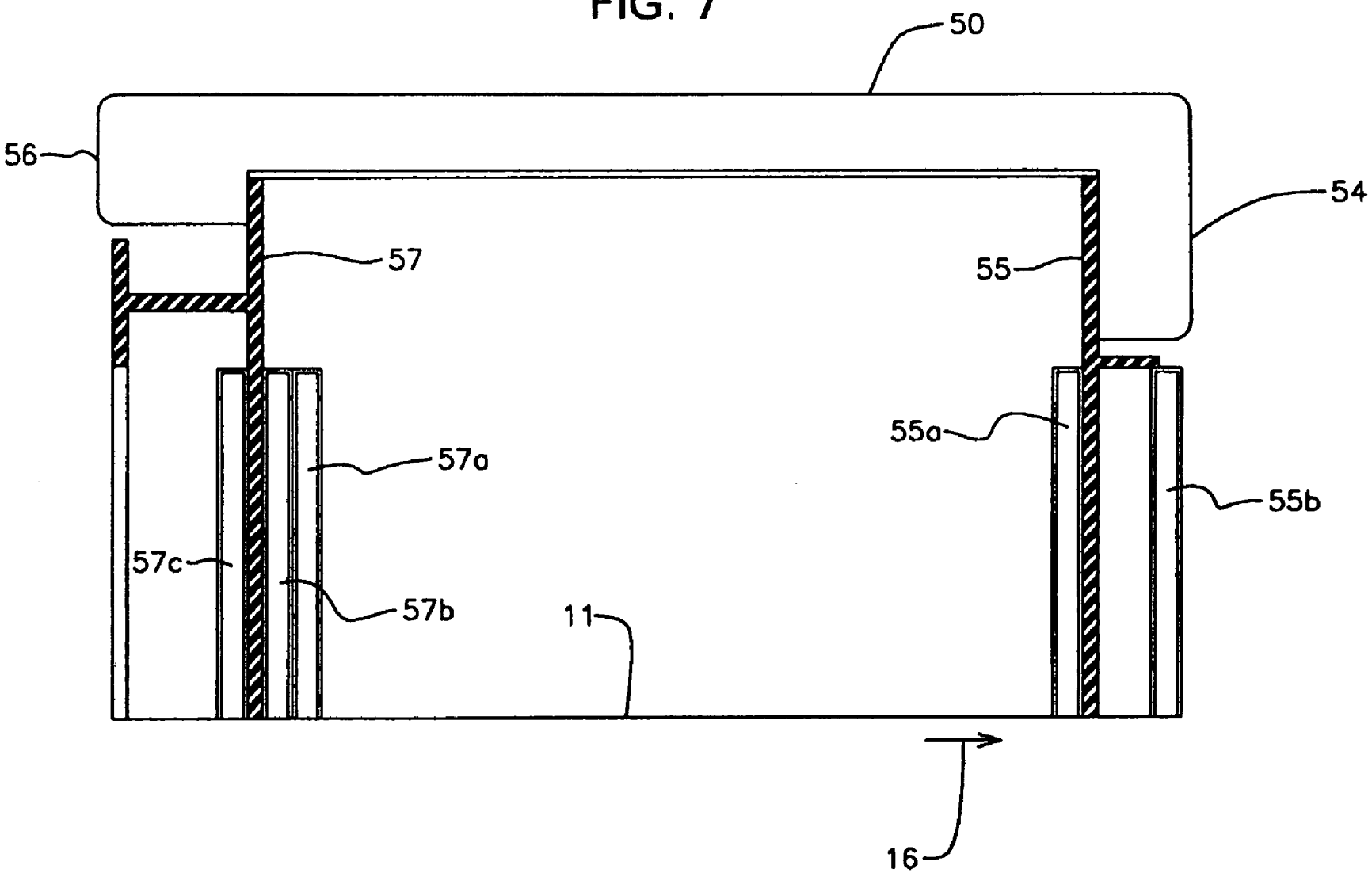
FIG. 7 is an interior view of the vacuum shroud means.

FIG. 7 provides an interior view of vacuum shroud 50. A first annular wiper ring 55 is secured to an interior surface of leading shroud end wall 54 and a second annular wiper ring 57 is secured to an interior surface of trailing shroud end wall 56. The respective radially innermost ends of said wiper rings 55 and 57 bear against pipeline 11 in sealing relation thereto to maintain the vacuum within vacuum shroud 50.

Annular brush 55*a* is secured to an interior surface of wiper ring 55 and another annular brush 55*b* is secured to said wiper ring in leading relation thereto. In a similar fashion, brushes 57*a* and 57*b* are secured to an interior side of trailing annular wiper ring 57 and brush 57*c* is secured to an exterior side thereof. The respective radially innermost ends of brushes 55*a*, 55*b* and 57*a*, 57*b*, and 57*c* bear against pipeline 11 in sealing relation thereto. The wiper rings and brushes maintain water vapor and debris emissions such as asbestos, lead, and other hazardous materials, at levels well below exposure limits established by the Occupational Safety and Health Administration while maintaining the vacuum within shroud 50 as already mentioned. The waste generated by the cleaning process is then recycled through a closed loop filtration system that separates solids from reusable liquid, thereby substantially reducing the quantity of disposable waste.

The oscillation of vacuum shroud 50, relative to the longitudinal axis of pipeline 11, as it advances along the length of pipeline 11 is best understood in connection with FIG. 5. The position of repose or top center of vacuum shroud 50 is indicated in solid lines and dotted lines indicate its respective positions when at the limits of its oscillation. When in its position of repose, a vertical plane passes through first limit switch actuator 50*a* and through the lowermost point of debris collection chamber 51. Carrier assembly 12 does not oscillate.

As best understood in connection with FIGS. 1–4, gears 70 and 72 are mounted on the respective output shafts of motors 74, 76, respectively. Gears 70, 72 include a plurality of circumferentially spaced apart truncate rods 73, 75 (FIG. 3) respectively, that are longitudinally aligned with a longitudinal axis of pipeline 11 and which are sandwiched between a pair of circular flat plates 74*a*, 74*b* (FIG. 2) and 76*a*, 76*b*, respectively. Rods 73, 75 are respectively engaged by sprocket teeth formed on sprocket gears 78, 80.

Large ring gear 82 (FIG. 4) is fixedly secured to the trailing end of vacuum shroud 50 as depicted in FIGS. 1 and 2 and has teeth 83 formed therein along about two hundred forty degrees (240° ) of its circumferential extent. Teeth 83 meshingly engage circumferentially spaced apart, longitudinally aligned truncate rods 86, 88 (FIG. 4) that form a part of gears 78, 80 (FIG. 3). Motors 74, 76 effect rotation of gears 70 and 72 which drive gears 78 and 80 and thus effect rotation of large ring 82. A pair of limit switches are mounted on non-oscillating carrier assembly 12 in positions of sixty five degrees (65° ) from either side of top center. Accordingly, as large ring gear 82 is rotated by motors 74, 76 in the manner described above, the large ring gear rotates until limit switch actuator 50*a* (FIG. 5) contacts first limit switch 50*b* which is mounted on non-rotatable carrier assembly 12 as mentioned earlier. Limit switch 50*b*, upon being thrown by the contact, sends a signal that reverses the direction of operation of motors 74, 76 so that the large ring gear 82 begins rotating in an opposite direction. The large ring gear 82 then rotates in the opposite direction until limit switch actuator 50*a* contacts second limit switch 50*c* and the second limit switch sends a signal that reverses the motors 74, 76. An oscillation cycle of one hundred thirty degrees (130° ) is thereby attained. Such oscillation of large ring gear 82 and hence of vacuum shroud 50 to which the ring gear is secured continues for as long as machine 10 is in operation.

The combination of linear travel and oscillatory motion of vacuum shroud 50 further ensures against the creation of hot spots.

In a preferred embodiment, three ultra high pressure water manifolds are mounted on vacuum shroud 50 in circumferentially and equidistantly spaced relation to one another. Thus, the manifolds are spaced about one hundred twenty degrees (120° ) apart from one another. Two of the manifolds are visible in the side view of FIG. 1 and the manifolds are collectively denoted 84. Hose 84*a* delivers ultra high pressure (40,000 lbs/in$^2$) water or other suitable liquid fluid and hose 84*b* delivers air at a suitable pressure to drive air motors which in turn rotate the nozzles. Element 84*c* is an electrical sensor in electrical communication with a programmable logic controller that shuts down the ultra high pressure nozzle flow if nozzle movement stops or the system air pressure drops. Similar sensors monitor the forward advance of carrier assembly 12 and the oscillation of vacuum shroud 50 and shut down the system if either of the motions stop. This fail-safe control eliminates potential pipeline or surface damage caused by extended nozzle dwell time.

Each manifold 84 includes four or five individual sapphire nozzles, each of which spins at three thousand revolutions per minute (3,000 rpm). This provides a uniform spray pattern over a two inch (2") or so diameter area. This unique manifold of spinning nozzles provides a uniformly cleaned surface that is free of hot spots and surface damage.

Mounting manifolds 84 in vacuum shroud 50 also ensures that the distance between each nozzle and the surface of the pipeline will always be a uniform distance. This eliminates the hot spots created by earlier machines that mount nozzles on opposite ends of rotating conduits.

The novel machine, to be known commercially as the Pipe Viper™ pipeline surface preparation system, is constructed of modular components. The components are easily pinned, bolted, clamped or otherwise easily affixed into place. The apparatus may be disassembled and reassembled on a pipeline in less than one hour. Its low weight and small size makes it easy to handle and to maintain.

The components of the modular assembly are of manageable weight for two people. Two people can disassemble or reassemble the unit without employing cranes, hoists, or other lifting mechanisms. Thus, no large weights are suspended over the pipeline which could fall and damage it. This further eliminates the need to excavate the site to accommodate a crane or lifting hoist. Moreover, the light weight of apparatus 10 does not stress the pipeline.

The industry standard for clearance around a pipeline undergoing reconditioning is eighteen inches and the novel apparatus fits easily within this clearance area.

The modular design also increases productivity. A defective module can be quickly replaced in the field, thereby reducing downtime and increasing productive time. For example, the water jets are a wear item that require replacing from time to time. The modular design of the novel apparatus enables the entire nozzle assembly to be removed and replaced in the trench in less than five minutes. Exchanging nozzles in the nozzle holder can then be accomplished in a bench repair environment. The repair is accomplished in the absence of any need to disassemble the vacuum shroud or the carrier assembly.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

While the foregoing is directed to embodiments of the present invention, other and further embodiments of the invention may be devised without departing from the basic scope thereof, and the scope thereof is determined by the claims that follow.

The invention claimed is:

1. A machine that performs surface preparation of a pipeline by stripping coating therefrom, comprising:

a vacuum shroud having:

a main wall that surrounds a longitudinally-extending section of the pipeline, the main wall having a plurality of equidistantly and circumferentially spaced apart nozzle openings;

end walls apertured to receive the pipeline;

a vacuum opening; and an ultra high pressure water nozzle positioned within each of the nozzle openings;

a carrier assembly for causing the vacuum shroud to travel along the pipeline in a predetermined direction;

an oscillating means for oscillating the vacuum shroud in a first rotational direction and in a second rotational direction that is opposite to the first rotational direction as the vacuum shroud travels along the pipeline;

a vacuum hose having a leading end connected to the vacuum opening and a trailing end adapted to be connected to a remote source of negative pressure; and a filter trap for collecting debris stripped from the pipeline, the filter trap disposed between the vacuum opening and the remote source of negative pressure whereby the debris is collected within the filter trap and is not discharged into the atmosphere.

2. The machine of claim 1, wherein the carrier assembly includes a frame having a leading end that circumscribes the pipeline, a trailing end that circumscribes the pipeline, and interconnecting frame members that couple the leading end and the trailing end to one another.

3. The machine of claim 2, further comprising a stand off means for positioning the frame in a concentric and encircling relation to the pipeline.

4. The machine of claim 3, wherein the stand off means includes a plurality of wheel members that are rotatably mounted to the frame and rollingly engage the pipeline.

5. The machine of claim 4, wherein the plurality of wheel members includes a driving wheel assembly that forms a part of the carrier assembly and a plurality of passive wheel assemblies that are circumferentially spaced apart from one another and from the driving wheel assembly.

6. The machine of claim 5, wherein the driving wheel assembly includes a leading drive wheel and a trailing drive wheel that are in line with one another and which rollingly engage the pipeline at longitudinally spaced apart points.

7. The machine of claim 6, wherein the driving wheel assembly surmounts the pipeline.

8. The machine of claim 1, wherein the main wall has a cylindrical main body and a wedge-shaped lower body formed integrally therewith, the wedge-shaped lower body having a lowermost point positioned coincident with a vertical plane that bisects the pipeline when the machine is in a position between the first rotational direction and the second rotational direction so that debris created when the coating is stripped from the pipeline falls under the influence of gravity into the wedge-shaped lower body.

9. The machine of claim 8, wherein each of the nozzle openings is formed in the cylindrical main body so that each ultra high pressure water nozzle is spaced a uniform distance from the pipeline whereby hot spots are not created when the machine is in operation.

10. The machine of claim 9, wherein the vacuum opening is formed in the wedge-shaped lower body at the lowermost point.

11. The machine of claim 2, wherein the oscillating means includes a ring gear that circumscribes the pipeline, the ring gear being mounted to the vacuum shroud.

12. The machine of claim 11, further comprising a first motor and a second motor mounted to the frame in a circumferentially spaced relation to one another, the first motor driving a first gear train that meshingly engages the ring gear at a first predetermined location and the second motor driving a second gear train that meshingly engages the ring gear at a second predetermined location that is circumferentially spaced apart from the first predetermined location.

13. The machine of claim 12, wherein the first motor and the second motor are reversible.

14. The machine of claim 13, further comprising a first limit switch and a second limit switch mounted on the leading end of the frame at a circumferentially spaced apart position.

15. The machine of claim 14, further comprising a limit switch actuator mounted on the vacuum shroud.

16. The machine of claim 1, further comprising an automatic motion sensing system that sends a signal to a shutdown control system to immediately deactivate the machine when no longitudinal and/or oscillating motion is electronically detected.

17. The machine of claim 1, further comprising a closed loop filtration system to filter and recycle water used in the machine.

18. The machine of claim 1, wherein each of the ultra high pressure water nozzles are adapted to spin.

19. A pipeline refurbishing tool for removing a coating from a pipeline, comprising:

a two-part body comprising a frame section and a coating removal section, the two-part body adapted to releasably couple to the pipeline and to move relative to the pipeline, wherein the frame section comprises:

a carrier assembly;

at least two drive wheels coupled to a drive motor providing motive force in at least a first direction; and at least two trailing drive wheels spaced-apart from the at least two drive wheels, and wherein the coating removal section comprises:

a ring gear coupled to at least two reversible motors providing motive force in at least a second direction;

a plurality of high pressure fluid manifolds coupled to a shroud, the shroud coupled to the ring gear and having a wedge-shaped member formed therein; and a vacuum port coupled to the wedge-shaped member, wherein the first direction is orthogonal to the second direction.

20. A pipeline refurbishing tool for removing a coating from a pipeline, comprising:

a two-part body comprising a frame section and a coating removal section, the two-part body adapted to couple to the pipeline by a plurality of quick-release coupling means and to move relative to the pipeline, wherein the frame section comprises:

a carrier assembly;

at least two drive wheels coupled to a drive motor providing motive force in at least a first direction; and at least two trailing drive wheels spaced-apart from the at least two drive wheels, and wherein the coating removal section comprises:

a ring gear coupled to at least one gear that is coupled to at least one reversible motor providing motive force in at least a second direction;

a plurality of high pressure fluid manifolds coupled to a shroud, the shroud coupled to the ring gear and having a wedge-shaped member formed therein;

a plurality of wipers coupled to the shroud; and a remote source of pressure coupled to a vacuum port in the lowermost part of the wedge-shaped member, wherein the first direction is orthogonal to the second direction.

* * * * *